US006568226B1

(12) United States Patent
Ramsauer

(10) Patent No.: US 6,568,226 B1
(45) Date of Patent: May 27, 2003

(54) ROTATING-LOCK CLOSURE WITH TRACTION UNIT

(76) Inventor: Dieter Ramsauer, Am Neuhauskothen 20, D-42555 Velbert (DE)

( * ) Notice: Subject to any disclaimer, the term of this patent is extended or adjusted under 35 U.S.C. 154(b) by 0 days.

(21) Appl. No.: 09/856,281

(22) PCT Filed: Aug. 28, 1999

(86) PCT No.: PCT/EP99/06345

§ 371 (c)(1),
(2), (4) Date: Aug. 31, 2001

(87) PCT Pub. No.: WO00/31365

PCT Pub. Date: Jun. 2, 2000

(30) Foreign Application Priority Data

Nov. 19, 1998 (DE) ..... 298 20 711 U

(51) Int. Cl.[7] ..... E05B 65/06; E05C 5/02

(52) U.S. Cl. ..... 70/127; 70/379 R; 70/380; 292/67; 292/114

(58) Field of Search ..... 70/422, 379 R, 70/380, 139, 472, 223, 370, 373, 360, DIG. 62, 127; 292/63, 64, 65, 66, 67, 71, 109, 110, 111, 112, 113, 114

(56) References Cited

U.S. PATENT DOCUMENTS

| | | | | | |
|---|---|---|---|---|---|
| 2,269,264 | A | | 1/1942 | Haim | |
| 4,492,394 | A | * | 1/1985 | Dignan | 292/64 |
| 4,583,775 | A | * | 4/1986 | Bisbing | 292/64 |
| 4,763,935 | A | * | 8/1988 | Bisbing | 292/66 |
| 4,823,571 | A | * | 4/1989 | O'Gara | 70/139 |
| 5,070,716 | A | * | 12/1991 | Whorlow | 70/380 |
| 5,076,080 | A | * | 12/1991 | Fuss et al. | 292/66 |
| 5,165,738 | A | * | 11/1992 | McCormack | 292/67 |
| 5,265,454 | A | * | 11/1993 | Crocco et al. | 70/101 |
| 5,409,272 | A | * | 4/1995 | McCormack | 292/229 |
| 5,737,950 | A | * | 4/1998 | Yun-Bin | 70/374 |
| 5,931,035 | A | * | 8/1999 | Bolton | 70/367 |

FOREIGN PATENT DOCUMENTS

| | | |
|---|---|---|
| DE | 35 02 418 | 8/1985 |
| DE | 35 04 691 | 11/1985 |
| EP | 0 905 340 | 3/1999 |

* cited by examiner

*Primary Examiner*—Anthony Knight
*Assistant Examiner*—Michael J. Kyle
(74) *Attorney, Agent, or Firm*—Reed Smith LLP

(57) ABSTRACT

A rotating-lock closure is provided with a traction unit, wherein the closure comprises a housing having a first bearing area for the receiving head of a key to be inserted as well as a second bearing area for the rotating-lock driving support that supports said rotating lock and is mounted so as to be capable of axial and sliding displacement and of rotation in the second bearing area. A shaft having a rounded cross section and extending from the key receiving head protrudes relative to the rotating-lock driving support and has a transverse opening at its protruding end for receiving a pin. A cam track, on which the pin is guided against the force of a spring, is formed by the side of the lock facing away from the housing. The outer periphery of the lock driving support has a non-rounded cross section and is capable, in a passageway also having a non-rounded cross section, of axial and sliding displacement in a first portion or the second bearing area and of limited rotation in a second portion of the second bearing area.

13 Claims, 8 Drawing Sheets

ROTATING-LOCK CLOSURE WITH TRACTION UNIT

CROSS-REFERENCE TO RELATED APPLICATIONS

This application claims priority of PCT Application Ser. No. PCT/EP99/026345 filed Aug. 28, 1999 and German Application No. DE 298 20 711.7, filed Sep. 19, 1998, the complete disclosures of which are hereby incorporated by reference.

BACKGROUND OF THE INVENTION a) Field of the Invention

The invention is directed to a rotating-lock closure provided with a traction unit, which comprises a closure housing that has a socket key opening on one outside end and a rotating lock on the other, inside end; which can be inserted with one end through a passageway matching the outside cross-section of the housing and which is in a wall, for example, a door leaf; and which can be fixed in position; with a first bearing area which is open to the outside end and coaxial with the housing axis and which is intended for the socket key receiving head, as well as a second bearing area open toward the opposite end of the housing that connects with the first bearing area and which is intended for the rotating-lock driving support that supports said rotating lock and is mounted so as to be capable of axial and sliding displacement and of rotation in the second bearing area, wherein a coupling device is to be provided between the key receiving head and the rotating-lock, and wherein the closure is to be provided with a cam pin/cam track device for the rotation and/or axial displacement of the rotating-lock relative to the key receiving head and a limited angular play/freewheeling exists between the key receiving head and the rotating-lock.

b) Description of the Related Art

Such a rotating-lock closure is already known, cf. DE 35 04 691 C2.

Furthermore, the closure arrangement according to DE 35 02 418 C2, which is of a similar design, should also be referred to.

U.S. Pat No. 2,269,264 is also of interest.

All three known closures work like this: when the lock or sash lock is operated for the purpose of closing, it is at first rotated into the door-closing position. This normally means a rotation of 90 degrees. If the operating handle is rotated further after this, a traction movement takes place by means of which the lock is pulled towards a surface behind which it engages (rear engaging surface) so that a force of pressure is attained between, for example, the door and the door frame. This combined rotating and axial movement is attained by means of a cam pin/cam track device; in the case of DE 35 02 418 C2, this is arranged in the handle levering area, while for DE 35 04 691 this has been moved into the inside of the lock housing and is in the shape of a sleeve arranged between the lock housing on the one side and the shaft holding the lock on the other side; in it, slits are arranged that run axially and diagonally in which the ends of a cam pin, realized as a transverse pin inserted in the shaft bearing the lock, slide. U.S. Pat. No. 2,269,264 does not have this housing. Instead, an operating shaft 21 with an operating head 22 is held so that it can rotate inside a holding plate 15 which is riveted to a flap 13 that can be hung on the frame 10. The holding plate 15 forms back stops 18 and guides 16 for a lock (sash lock) 23 which is supported by a sleeve 24 provided with cam tracks 28. The end of the operating shaft 21 facing away from the operating head 22 support cam pins 28 sliding in cam tracks 28 while under pressure from a spiral spring 29 arranged between the holding plate 15 and the lock 23.

The disadvantages of prior art lie in the complicated construction which results in increased production costs and laborious assembly. For example, the closure according to DE 35 04 691 C2, cf. its FIG. 2, comprises a closure housing with a flange, which can be mounted in a wall with two screws (or alternatively with a union nut); a key receiving head held in the housing by a retainer ring; a rotating-lock driving support mounted in this so as to be capable of axial and sliding displacement which supports the rotating-lock, the lock being fixed to this support by means of two nuts; a pin which goes transversely through the support and the ends of which are guided in the cam tracks of a sleeve that needs to be produced separately in a complicated punching process and which in turn is arranged inside the housing and coupled to the receiving head in a manner that permits rotation. Finally, there is a pressure spring which pushes the shaft towards the outside, that is towards the open position.

This means that the arrangement known from DE 35 04 691 CS consists of ten parts, some of which have to be produced in a complicated manner.

The closure known from U.S. Pat. No. 2,269,264 needs a lot of space, is not protected against dirt, since it has no housing, and mounting the holding plate on the flap requires laborious riveting.

OBJECT AND SUMMARY OF THE INVENTION

It is the primary object of the invention to create a rotating-lock closure of the type mentioned in the beginning which is made of significantly less parts that are simpler to produce and which therefore is cheaper to produce and easier to assemble.

This object is met by the fact that a shaft having a rounded cross section and extending from the key receiving head protrudes beyond to the rotating-lock driving support and has a transverse opening at its protruding end for receiving a cam pin. A cam track, on which the pin is guided against the force of a spring, is formed by the side of the lock facing away from the housing. The outer periphery of the lock driving support has a non-rounded cross section and is capable, in a passageway also having a non-rounded cross section, of axial and sliding displacement in a first portion of the second bearing area and of limited rotation in a second portion of the second bearing area. Such an arrangement has significantly less parts, for example only six parts. This makes it cheaper to produce and easier to assemble. The cam track is on the outside and can be injection-molded in simple injection molds. The coupling device is protected inside the housing and is of a particularly simple construction because the bearing area portions are smaller than, for example, the arrangement in U.S. Pat. No. 2,269,264. The rotation capability is preferably to be restricted to about 90 degrees.

It is advantageous if the non-rounded cross section of the lock driving support is a parallelogram with rounded corners.

The non-rounded cross section of the passageway in the second portion of the second bearing area could consist of two opposing segments of a circle connected with each other by two parallel side walls or by lug areas projecting into the lumen of the passageway.

With regards to the housing, it is advantageous if the housing is divided into the first and second bearing area by a dividing or partition wall, this dividing wall having a circular passageway for the passage of the shaft which starting at the key receiving head penetrates the lock driving support. In this manner, the use of a retainer ring is avoided.

According to another, different development, the key receiving head supports itself by a rear ring shoulder on the dividing wall and in the first bearing area.

In the second bearing area, a spiral pressure spring supports itself on the dividing wall on one side and on the face of the of the lock driving support on the other side.

It is particularly advantageous if the rotating-lock forms a reinforcing wall which encloses the cam track in a circle and which stops the cam pin from sliding out. By means of this, fixing the cam pin by means of an interference fit is no longer necessary, which makes disassembly as well as assembly significantly easier.

The rotating lock could form a constriction which is directed towards the housing and which permits the insertion of the tongue of the rotating lock and also of the assembled housing, meaning the completely assembled closure, through an opening in a thin wall (and, if necessary, the pushing-on of a union nut). This is also a feature which makes mounting a lot easier, since rotating-lock closures can be mounted in a thin wall ready-assembled.

Such a rotating-lock is particularly advantageous when the rotating-lock closure consists of a closure housing which has a flange on the one, outside end and which can be passed through a passageway matching the outside cross section and being situated in a thin wall, for example a door leaf, by the other, inside end until the flange rests on the wall, and can be fixed in this position by means of a union nut, a retaining clip or something similar.

As an alternative, a rotating-lock closure can be envisaged that has a closure housing which has a flange or attaching lug at the one (inside) end and which can be passed through a passageway matching the outside cross section and being situated in a thick wall, for example a door leaf, by the other (outside) end until the flange rests on the wall, and can be fixed in this position by means of holding washers and/or screws.

According to another different embodiment of the invention, the rotating-lock can have a thread on its free end for receiving an adjusting screw the head of which forms an adjustable rotating-lock support surface. This permits additional adjustment of depth and force of pressure.

According to a further development of the invention, the rotating-lock closure comprises a lock receiving part which can be fixed to the housing or frame or something similar and which forms the surface behind which the rotating-lock engages. Such a rotating-lock closure can advantageously be lodged in the free space between, for example, the frame and the folded portion of door.

The lock receiving part preferably forms two rear engaging surfaces which are situated diametrically opposite each other. This has the advantage of making it possible for the rotating-lock to be toggle-shaped, as it is to be provided according to another embodiment form of the invention, which makes it possible in an advantageous manner that the lever-like rotating-lock inserts itself without jamming after a 90 degree rotation in the lock receiving part on the frame when closing the door and, for example, aligns the door vertically. After another 90 degree rotation, the lever-like lock part or tongue is tightened.

The big advantage compared with customary rotating-lock closures for which the traction movement along the rotation axis happens at the same time as the rotation movement of the lock ("sash lock") into the closed position (for example by chamfering the leading surfaces of the lock, cf. for example the stepped tongue according to catalogue page 1–2000 of the 1996 catalogue of the company DIRAK or according to EP 0058931) and where because of this and by means of friction forces the door leaf is displaced and distorted relative to the door frame and vertical to the axis of rotation, is the exact alignment right at the beginning of the closing process.

The invention is subsequently to be detailed by means of embodiment examples represented in the drawings.

BRIEF DESCRIPTION OF THE DRAWINGS

In the drawings:

FIG. 19 shows a side view of another different embodiment form of the invention comprising a rotating-lock closure and a lock receiving part attached to the housing or frame or something similar;

DESCRIPTION OF THE PREFERRED EMBODIMENTS

Figure 1:
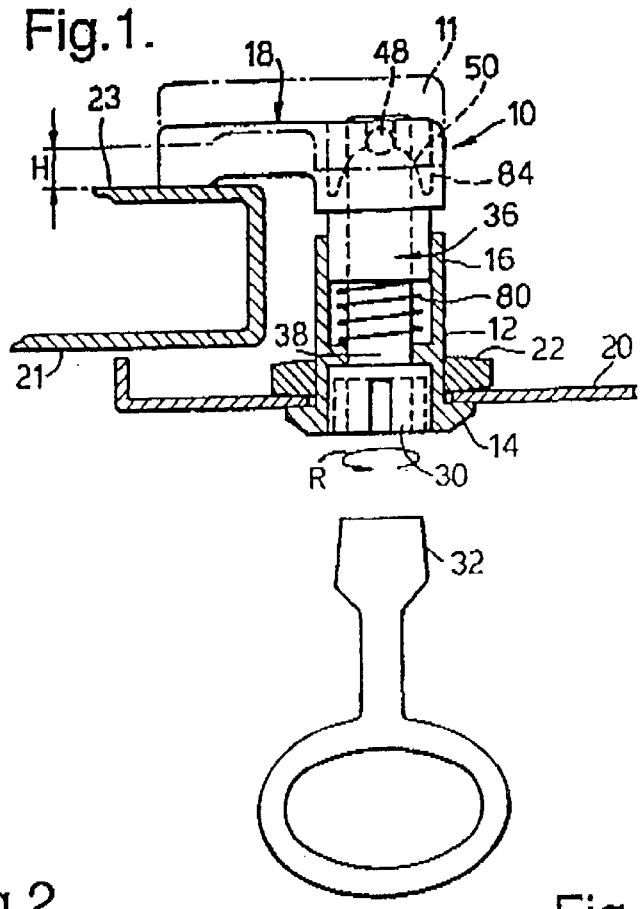
FIG. 1 shows a side view of an axial section of a closure formed according to the invention, mounted in a door.
Figure 17:
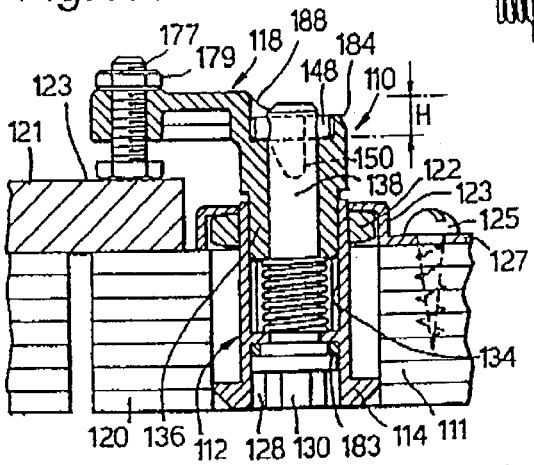
FIG. 17 shows the closure according to FIG. 7 with an alternative attachment in a thick wall in a view similar to the one in FIG. 1.

FIG. 1 and FIG. 17 show in an axial sectional view of a rotating-lock closure 10, 110 with a traction unit that will be detailed later, the rotating-lock closure comprising a closure housing 12, 112 which has a flange 14, 114 on one end. The other end and the further devices emerging from this end, meaning the rotating-lock 18, 118, can be passed through a passageway in a wall, for example, a door leaf 20 or a wall-closing flap 120, which matches the outside cross section of the housing (for example, rounded with flattened portions spaced at 90 degrees from each other, as can, for example, be seen in FIG. 4B). They can be fixed in this position by means of a union nut 22, a retaining clip, cap screws 125 (as for prior art), holding springs protruding from the housing wall, or similar devices. For the embodiment form shown in FIG. 1, see also FIG. 4B, a union nut 22 is used which is screwed onto an outside thread 24 attached to the outside surface of the housing 12. To secure the housing against rotating inside the wall 20, the housing has at least one flattened portion 26 which works in conjunction with a corresponding chordlike constriction of the associated passageway and thus secures the housing against rotation inside the passageway. For practical purposes, four flattened portions 26 offset from each other by 90 degrees are provided so that the housing 12 can be fitted in four positions, each representing a rotation of 90 degrees. Correspondingly, the passageway in the wall 20 could also have four such chordlike constrictions.

Figure 4A:
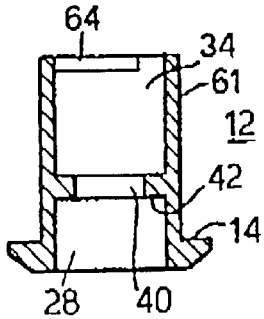
FIG. 4A shows an axial section of the housing.
Figure 4B:
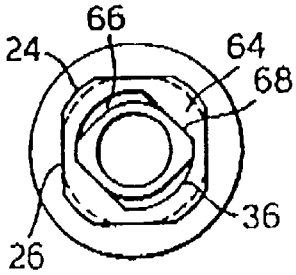
FIG. 4B shows a top view onto the housing according to FIG. 4A.
Figure 5:
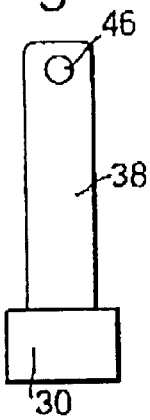
FIG. 5 shows a side view onto the combination key receiving head and drive shaft.
Figure 6A:
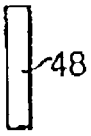
FIGS. 6A and 6B show two views of the cam pin.
Figure 6B:
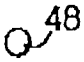
Figure 10A:
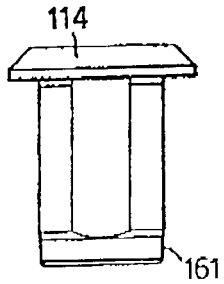
FIG. 10A shows a side view of the closure housing.
Figure 10B:
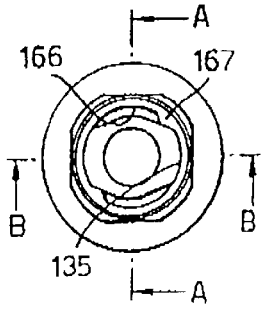
FIG. 10B shows a view from above of the closure housing.
Figure 10C:
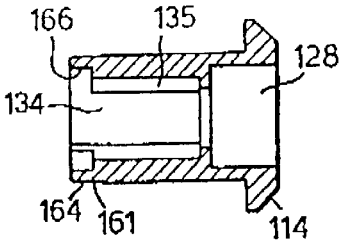
FIG. 10C shows a sectional view along the line A—A in FIG. 10B.
Figure 10D:
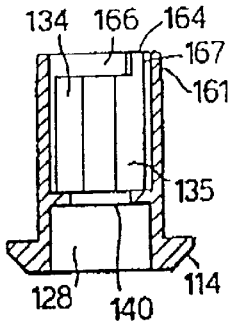
FIG. 10D shows a sectional view along the line B—B in FIG. 10B.
Figure 12A:
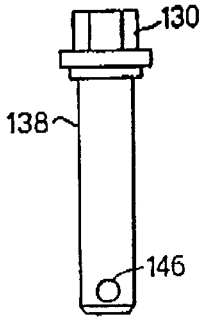
FIG. 12A shows a side view of the drive shaft of the closure according to FIG. 7.
Figure 12B:
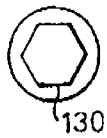
FIG. 12B shows a view from above of the shaft according to FIG. 12A.
Figure 13A:
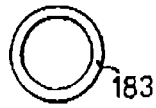
FIG. 13A shows a view from above of the O-ring seal of the closure according to FIG. 7.
Figure 13B:
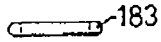
FIG. 13B shows a side view of the O-ring seal shown in FIG. 13A.
Figure 14:
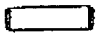
FIG. 14 shows a side view of the view of the transverse pin (cam pin) of the closure shown in FIG. 7.
Figure 15A:
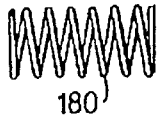
FIG. 15A shows a: side view of the pressure spring used according to the embodiment form used in FIG. 7 in its relaxed state.
Figure 15B:
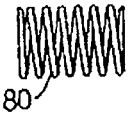
FIG. 15B shows the spring from FIG. 15A in the position that can be made out in FIG. 9C.
Figure 15C:
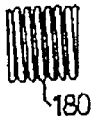
FIG. 15C shows the pressure spring according to FIG. 15A in a position like the one shown in FIG. 9A.
Figure 16:
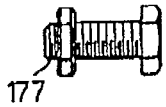
FIG. 16 shows a side view of the adjusting screw according to FIG. 7.

The housing 12, 112 according to FIGS. 4A or 10C and 10D, each an axial view of the housing, has a bearing area 28, 128 which is arranged in a direction coaxial to the housing 12, 112 axis and which is open towards the flange 14, 114; the receiving head 30, 130 (see also FIGS. 5 or 12A, 12B) for receiving an operating element, like a socket key 32, fits in here. Adjacent to this first bearing area 28, 128 in the housing 12, 112 is a second bearing area 34, 134 which receives the lock driving support 36, 136 mounted so as to be capable of axial and sliding displacement and of rotation and supporting the rotating-lock 18, 118.

Figure 3A:
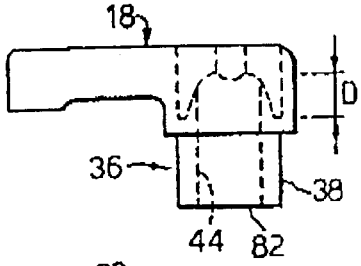
FIGS. 3A, 3B and 3C show three different views of the one-piece combination of rotating-lock and rotating-lock driving support with the cam track.
Figure 3B:
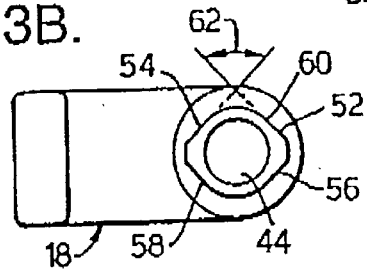
Figure 4C:
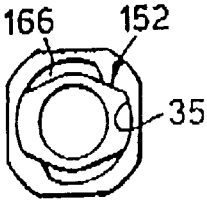
FIG. 4C shows an alternative embodiment form.
Figure 9A:
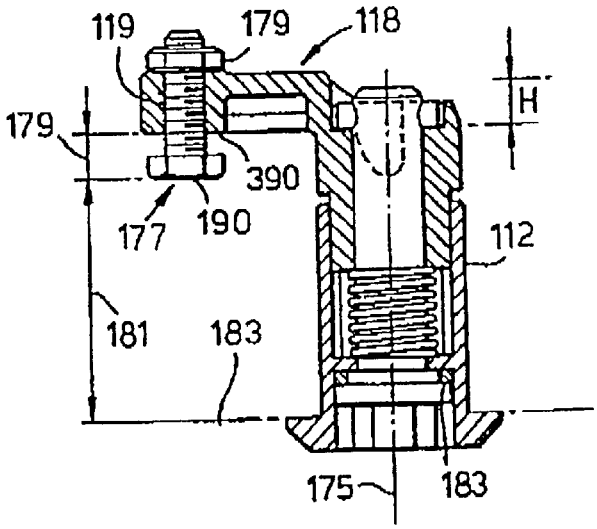
FIG. 9A shows a sectional view of the assembled closure according to FIG. 7 in the closed position.
Figure 9B:
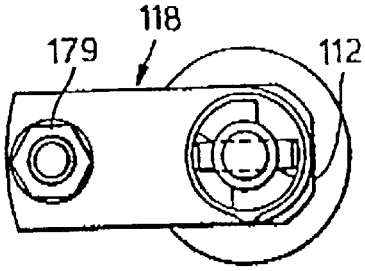
FIG. 9B shows a rear view of the closure according to FIG. 9A.
Figure 9C:
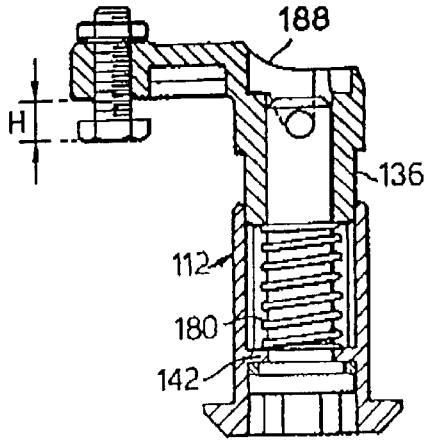
FIG. 9C shows the closure according to FIG. 9A but in a position no longer lifted.
Figure 9D:
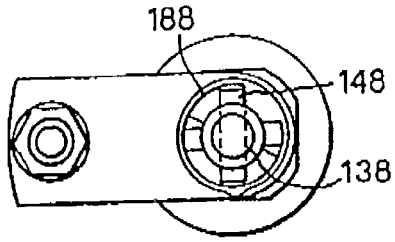
FIG. 9D shows a rear view of the closure in the position according to FIG. 9C.

A shaft 38, 138 with a rounded cross section extends from the head 30, 130 which first passes through a corresponding rounded borehole 140 in the dividing wall 42, 142 separating the two bearing areas 34, 134 and 28, 128 and then through a corresponding borehole 44, 144 in the lock driving support 36, 136 and which at its end forms a transverse passageway 46, 146 through which a cam pin 48, 148 is inserted, the ends of which are being supported on a cam track 50, 150 (present twice) formed on and around the outward-facing surface of the borehole 44, 144 of the rotating-lock 18, 118. The lock driving support 36, 136 has a non-rounded peripheral surface. 52, 152 which according to FIG. 3B consists of a parallelogram, i.e. of two faces 54, 56 or 58, 60 respectively that are parallel to each other, form an angle 62 not equal to 90 degrees and the connecting corners of which are rounded. This cross section can not be rotated in the non-rounded passageway 35, 135 formed by the bearing area 34, 134 and can only be displaced axially, as FIGS. 9A, 9C show; it also fits into a passageway 66, 166 formed by the end wall 64, 164 of the rear end 61, 161 of the housing 12, 112 in such a manner that in this position of the support 36, 136 in the housing 12, 112 a rotation range of, for example, 90 degrees is made possible; see FIGS. 9C and 9E. For this purpose, the passageway 66, 166 could be a circular passageway narrowed by two chordlike constrictions 68. FIG. 4C and FIG. 10B show another embodiment form for which the cross section of the peripheral surface 152 is designed slightly differently, i.e. wider at the longer ends; correspondingly, the shape of the passageway 166 is essentially a circular shape with two cam-like protrusions 167 that lie opposite to each other and which stop the cross section 152 at the two end positions which are 90 degrees apart.

Figure 9E:
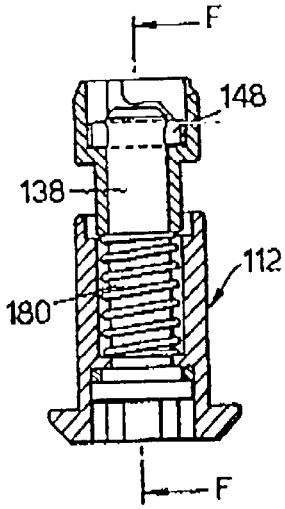
FIG. 9E shows an axial view rotated by 90 degrees of the position of the closure shown in FIG. 9C.
Figure 9F:
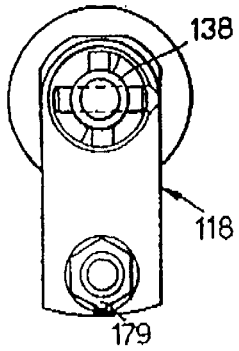
FIG. 9F shows a rear view of the closure according to FIG. 9E.

By means of this shape, the housing 12, 112 permits at the end of the shape 64, 164 a rotational movement of 90 degrees of the lock driving support in its position between housing 12, 112 and tongue 18, 118 shown in FIGS. 9C, 9E; this means between a position like the one shown in FIG. 1 or FIG. 17 and a position of the rotating-lock 18, 118 which is vertical to this.

Figure 3C:
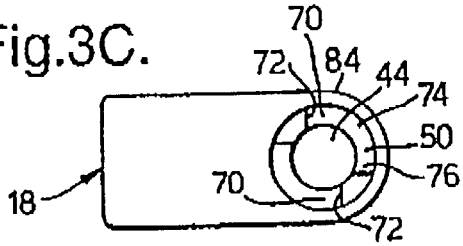
Figure 11A:
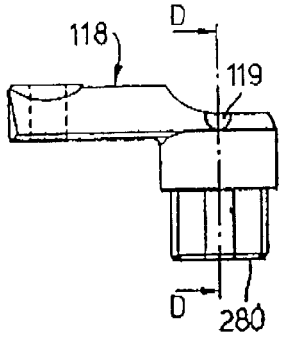
FIG. 11A shows a side view of the lock of the closure according to FIG. 7.
Figure 11B:
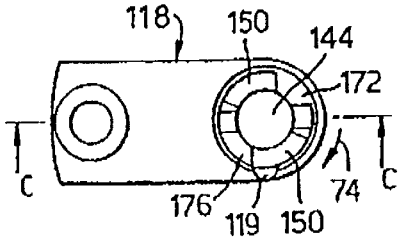
FIG. 11B shows a view from above of the lock according to FIG. 11A.
Figure 11C:
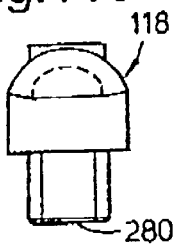
FIG. 11C shows a view from the right hand side of the lock shown in FIG. 11A.
Figure 11D:
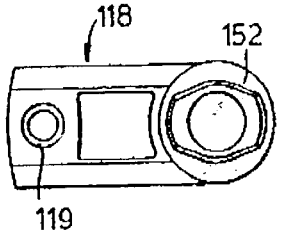
FIG. 11D shows a rear view of the lock according to FIG. 11A.
Figure 11E:
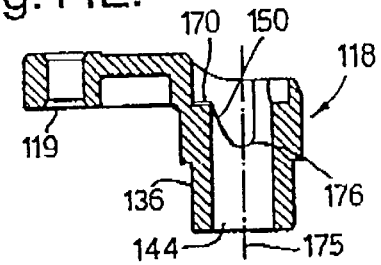
FIG. 11E shows a sectional view along the line C—C in FIG. 11B.
Figure 11F:
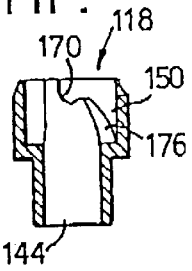
FIG. 11F shows a sectional view along the line D—D in FIG. 11A.

The cam track 50, 150 distinctly discernible in FIGS. 3C or 11E, 11F has a highest point 70, 170 that can also be seen represented by dashed lines in FIG. 4 and in which position the cross section is on one side stopped by an edge 72, 172, a further movement along the cam wall therefore not being permitted. It is situated in a small indentation on another side so that a stable resting position is attained here, as well; this happens in such a manner that a certain initial force is necessary for a movement away from this position, meaning in direction of the arrow 74, before the pin 48, 148 moves downwards along the cam track 50, 150, for example, with a travel of 6.5 mm to reach its lowest position where the pin meets a stop face 76, 176, the two stop positions 72, 172 and 76, 176 preferably permitting a rotation of the pin through 90 degrees.

A spiral pressure spring 80, 180 arranged in the second bearing area 34, 134 supports itself on one side on the dividing wall 42, 142 of the housing 12, 112 and on another side it pushes against the front 82 of the lock driving support 36, 136, by means of which in turn the rotating-lock 18, 118 pushes its cam track 50, 150 against the transverse pin 48, 148.

Figure 18:
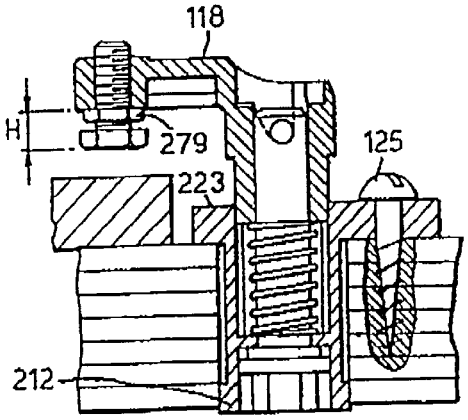
FIG. 18 shows still another type of attachment.

The arrangement therefore functions in the following manner: Starting at the closed position of the rotating-lock closure shown in FIGS. 1, 17, at first the key 32 is inserted in the receiving head 30, 130; then, the key 32 is turned counterclockwise. After overcoming a small amount of resistance (lifting of the cam pin 48, 148 from the small indentation which can, for example, be seen in FIG. 3A or FIG. 11F), which means displacing the tongue 18, 118 against the force of the spring 80, 180 by about 0.5 mm, the cam or pin 48, 148 subsequently slides downward in direction of the arrow 74 until it reaches the stop point 76, 176; because of the pressure of the spring 80, the lock 18 moves outwards by a travel distance of, for example, 6 mm during this movement without being able to rotate inside the housing. Upon further turning, the cam or pin 48, 148 resting on the edge 76 only engages the lock so that it rotates along with it when the position visible, for example, in FIG. 18 is attained; in this manner, the lock driving support 36, 136 is rotated from the one stop position to be seen in FIG. 4B into a second stop position displaced by 90 degrees. Now the rotating-lock is in a position which differs by 90 degrees from the one in FIG. 1, has been lifted by a travel distance of, for example, 6 mm and which is shown in dashed lines with the reference number 11 in FIG. 1. The closing process is done in the reverse direction, meaning the turning is done clockwise, the position of the lock driving support 36 shown in FIG. 4B being reached first after a rotation of 90 degrees, a further rotation of the lock driving support being stopped by the housing 12, 112. Because the edges 52 or 152 are stopped by the corresponding passageway-walls of the passageway in the housing 12, 112 arranged in the end wall 64, the rotating-lock 18 can turn no further along with its lock driving support 36, 136; upon further turning of the operating key 32 only the shaft 38 rotates any further. This means that the pin 48 at the top end of this shaft 38 moves slidingly from a lowest point to a highest point in the opposite direction of the arrow 74; during this, it slides along the cam surface and pushes the lock 18 downwards by the travel distance until the rotating-lock 18 has reached the position shown as a continuous line in FIG. 1. In this position, the lock 18, 118 pushes against a rear engaging surface 23, 123 formed, for example, by the housing of a cabinet 21, 121 and thus keeps the door leaf 20, 120 in a closed position fitting closely to the door frame 21, 121.

The advantage of this mode of operation lies in the fact that the rotating movement of the lock 18 happens before contact with the rear engaging surface 23 is made or while this contact is still loose. Only when the closed position has been reached is the lock pulled in and the final closing (contact is under pressure) effected.

Figure 2:
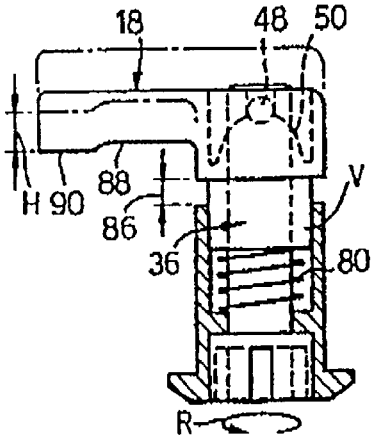
FIG. 2 shows a side view onto the closure according to FIG. 1.
Figure 8:
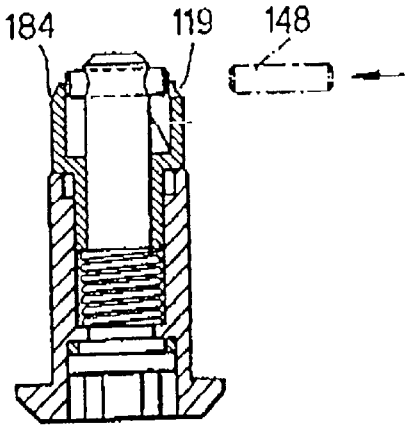
FIG. 8 shows a sectional view corresponding to the section line E—E in FIG. 7 to illustrate the assembly of the closure according to FIG. 7.

It should be added that one wall 84, 184 of the rotating-lock 18, 118 encloses the cam track 50, 150 to be seen in FIGS. 1 or 17 in a circular shape, see also FIG. 3C and FIG. 8; this means that the pin can be loosely inserted in the transverse borehole 46, 146 without any danger of it falling out. For the insertion of the pin during initial assembly, all that is required is that the rotating-lock 18 needs to be pushed in against the force of the spring 80 beyond the position shown in FIG. 2 by a travel distance 86 of about 4 mm so that the borehole 46 stands free of the wall 84 and the pin 48 can be slid in. This position is never assumed during normal operations so that the security of the pin in its borehole 46 is guaranteed during normal operations. According to FIG. 8, the travel distance is reduced by the arrangement of an indentation 119 at a suitable location in the upper front face of the wall 184 which permits the insertion of the pin 148 in the position shown in FIG. 8.

It should furthermore be pointed out that on its side facing the flange the lock 18 has a constriction 88. Because of this, the tongue does not need to be detached for the insertion of the complete arrangement according to FIG. 2 in a passageway with a cross sectional surface according to the cross section of the housing 12.

Furthermore, a defined support surface area 90 results on the rear engaging surface 23.

Figure 7:
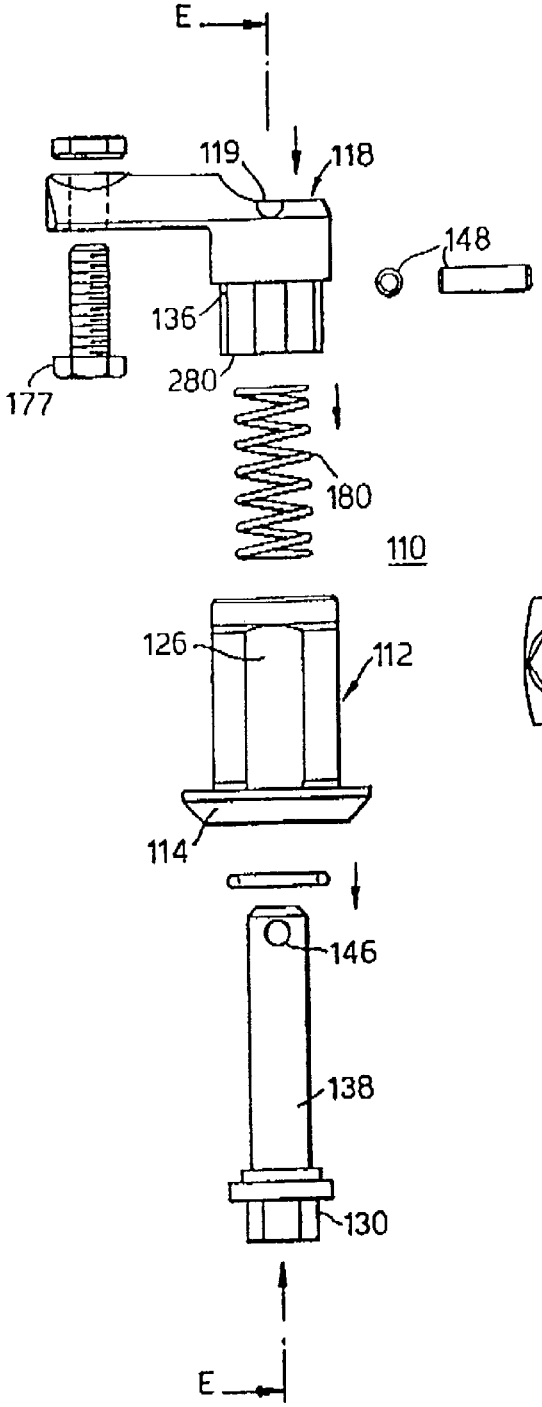
FIG. 7 shows an exploded side view of another embodiment form of the rotating-lock closure according to the invention, additionally with an O-ring seal and a set screw for additional adjustment of depth and force of pressure.

FIG. 7 illustrates in an exploded side view an alternative embodiment form of a rotating-lock closure 110 with a traction unit, the rotating-lock closure 110 comprising a closure housing 112 which has a flange 114 at its one end and other devices, i.e. the rotating-lock 118, emerging from its other end. In this case, the outside cross section of the housing also has flattened portions 126 spaced 90 degrees from each other so that four mounting positions differing by 90 degrees are made possible; this has already been described. For mounting in a thin wall, the attachment can be done in the same manner that was described according to FIG. 1; or alternatively in the case of a thick wall in the manner shown in FIG. 17. There, the housing is passed from behind through a passageway 111 in a relatively thick wall by its flange 114, preferably until the front face of the flange 114 is flush with the front wall surface of the wall 120. The housing is held by a nut 122 on the rear end of the housing 112, which in turn is held by a plate 123 suitably attached to the rear side of the wall 120; the plate 123 could, for example, have projections with passageways through which screws 125 extend that can be screwed into the wall.

Alternatively, the nut 122 could have projections with passageways through which attachment screws 125 or something similar can be passed so that the nut can be fixed on the wall 120.

According to yet another alternative, see FIG. 18, the housing 212 is provided with a flange 223 arranged at its rear end which in turn is provided with passageways and can be screwed to the wall 120 by means of screws 125.

The form of the housing used according to FIG. 7 is emphasized more in the FIGS. 10A to 10D; essentially, it corresponds to the embodiment form according to FIG. 4C.

The form of an alternative lock construction shown in FIGS. 11A to 11D mainly differs from the construction shown in FIGS. 3A to 3C by the fact that a threaded borehole 119 is provided near the end of the rotating-lock 118. The axis of the thread is parallel to the axis 175 of the rotating-lock; a cap screw 177 can be screwed into said threaded borehole in such a manner that the cap of this cap screw works in conjunction with a support surface 190 (FIG. 9A), as FIG. 17 illustrates. By turning this screw 177, the distance 181 of the support surface 190 and, for example, the flange contact surface 183 can be changed so that different diameters of walls or a desired force of pressure can be taken into consideration. For fixing this position, a locknut 179 is used in a position according to FIG. 17 or a locknut 279 is used on the opposite side according to FIG. 18.

If the screw 177 is turned out all the way, a support surface 390 results.

It is worth mentioning an O-ring seal which makes the housing 112, 212 water- or gastight.

In contrast to the indentation 88 according to FIGS. 3A to 3C, here, an indentation 188 is arranged on the side opposite to the tongue of the lock 118, that is, in the area of the drive shaft, but this serves the same purpose of making it easier to push on a union nut 122 or of making it easier to pass the closure through a thin wall.

Figure 19:
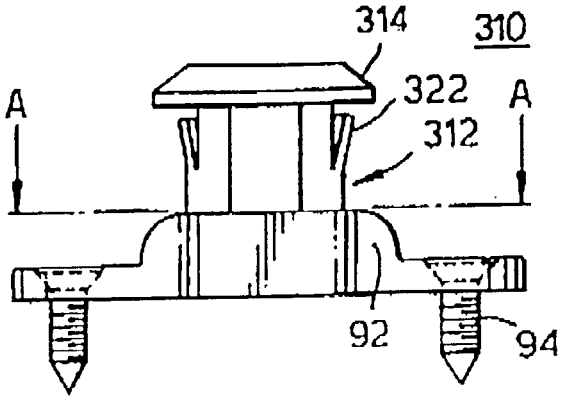
Figure 20A:
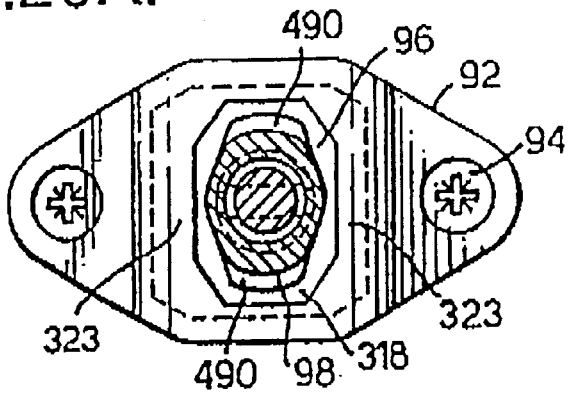
FIG. 20A shows a sectional view along the line A—A in FIG. 19 in a first position of the rotating-lock.
Figure 20B:
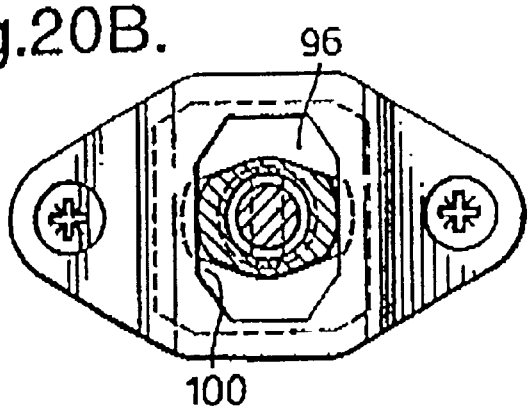
FIG. 20B shows a view similar to the one in FIG. 20A, but with a position of the rotating-lock that has been rotated by 90 degrees.
Figure 21A:
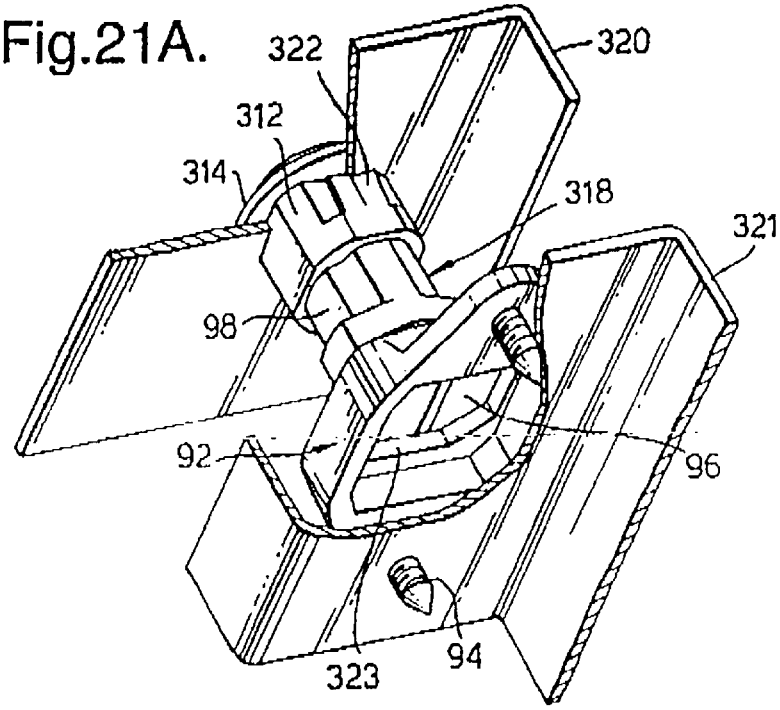
FIG. 21A shows a perspective view of the rotating-lock closure in FIG. 19 after it was mounted in a door leaf or door frame and in a position before closing the door.

FIG. 19 shows a side view of another different rotating-lock closure 310 which comprises a closure housing 312 that has a flange 314 in a manner that has already been described and a rotating-lock 318 emerging from its other end, see the perspective view in FIG. 21A; wherein the housing 312 can be passed through a passageway in a door leaf 320 matching the outer cross section of this housing so that it preferably can not be rotated and so that it is fixed in this position by means of retaining springs 322 made of plastic and injection molded together with the housing and as one part. Complementary to the rotating-lock 318, a lock receiving part 92 is provided on the cabinet housing or frame 321, preferably in the so-called folding area between door leaf 320 and frame 321, which in place of a folded portion of the cabinet housing forms the rear engaging surface 322 for the rotating-lock 318. As it can be seen in FIGS. 19 and 21A, the lock receiving part 92 is U-shaped, both ends of which have countersunk passageways for receiving fastening screws 94 with which the lock receiving part 92 can be fastened to the cabinet housing 321, as it can be seen in FIG. 21A. This figure also makes it clear that the lock receiving part is cup-shaped, the bottom of the cup comprising a rectangular opening 96 with constricted corners which has been given a size that permits with some lateral play the passage of a toggle-like rotating-lock 318 in a position aligned with the longitudinal extent of the opening 36, as it is illustrated by FIG. 20A. The aforementioned rear engaging surfaces 323 behind which the support surfaces 94 formed by the toggle 318 engage when this toggle is rotated into a position differing by 90 degrees from the position in which this toggle is aligned with the lengthwise direction of the opening 96 shown in FIG. 20A result because this opening 96 is longer than it is wide, as it is illustrated by FIG. 20B. This rotated position is also shown in FIG. 21C.

Figure 21C:
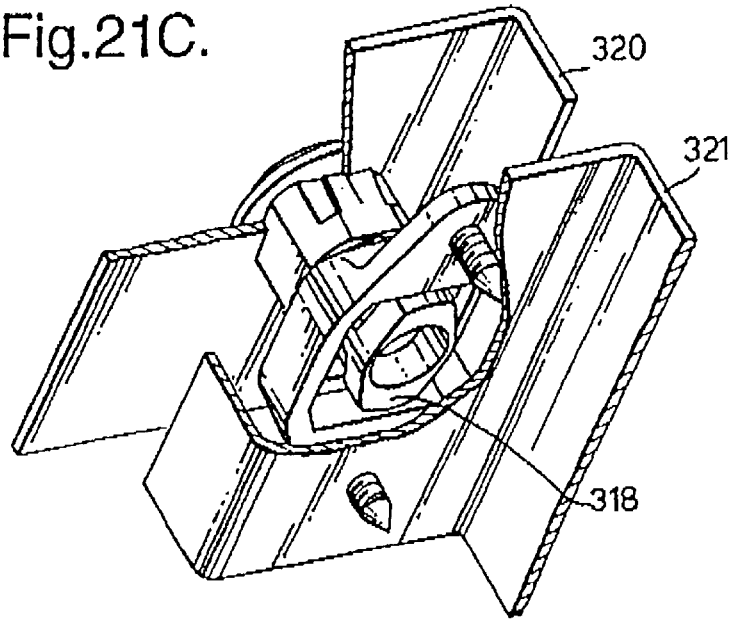
FIG. 21C shows a view similar to FIGS. 21A and 21B but in a position in which the rotating-lock is at first rotated by 90 degrees.
Figure 21B:
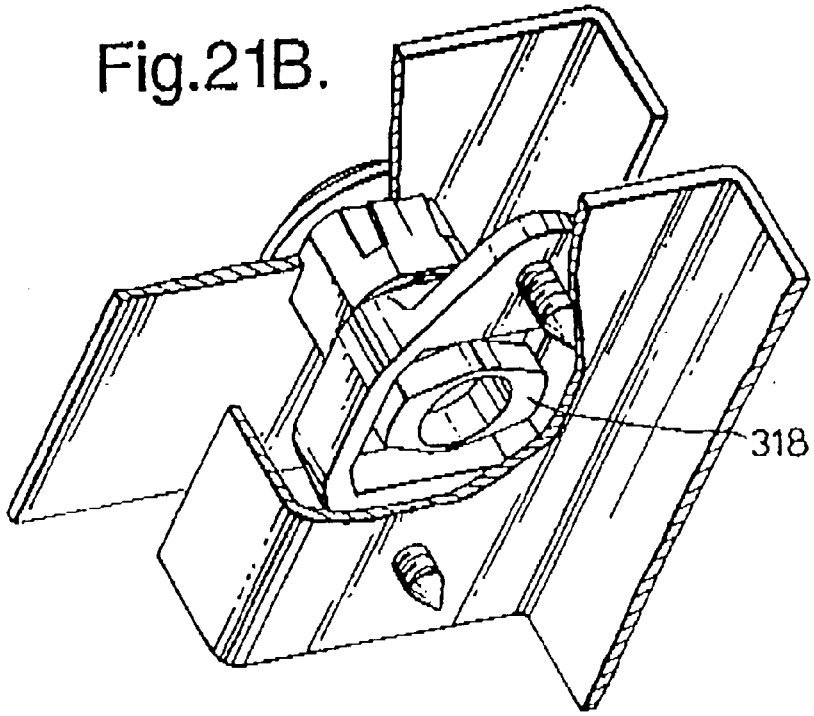
FIG. 21B shows in a view similar to FIG. 21A the position in which the rotating-lock has entered the lock receiving part.
Figure 21D:
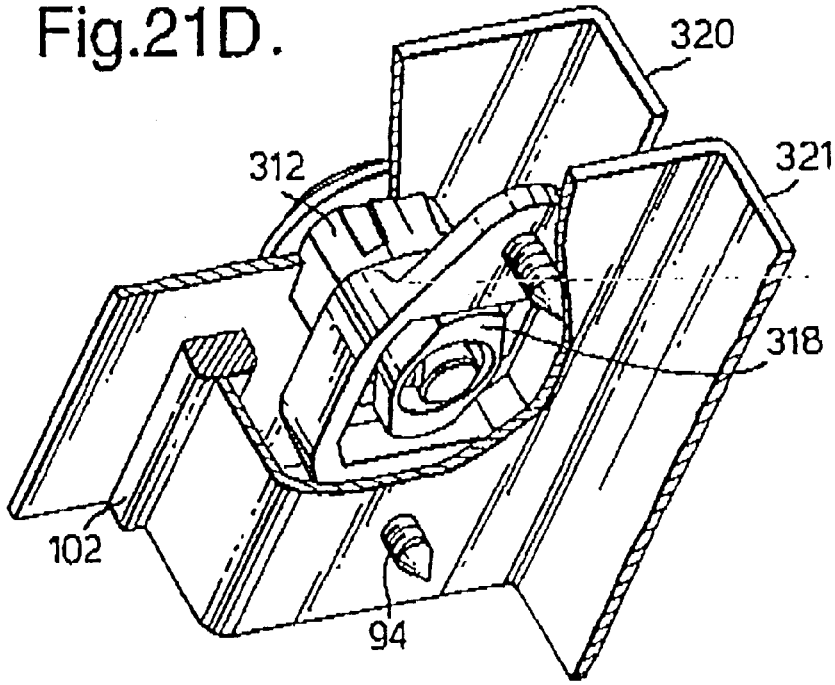
FIG. 21D shows the position in which the rotating-lock has been tightened by a rotation of the operating key through a further 90 degrees.

When operated further, that is to say, rotated further by 90 degrees, the toggle-shaped rotating-lock is pulled into the housing 312 which causes it to move from its position shown in FIG. 21C to the position shown in FIG. 21D. During this process of movement, the door leaf 320 is pulled towards the door frame 321 and at the same time the door leaf 320 is aligned relative to the door frame 321; this is the advantage this embodiment form has over the already described embodiment forms. This alignment results in particular in direction of the transverse extent of the passageway 96 according to FIG. 21D, that is in direction of the folded portions on door leaf and door frame, because this directional path only rests a projection of the toggle support area 98 with little or no play on the lengthways edges 100 of the passageway 96 if the toggle is in the position shown in FIG. 20B. In the position illustrated in FIG. 20A which is rotated by 90 degrees there is still play.

This alignment happens in direction of the folded portion of the door leaf or the door frame and is particularly important, since in this direction, for example, the weight of the door leads to distortions. This is valid especially for doors which are wider than they are high and which distort particularly easily because of this (small distance of the hinges to each other, long lever arm between door hinge point and hinges).

The sequence of FIGS. 21A, 21B, 21C and 21D therefore shows the closing process, beginning in FIG. 21A with swinging the door leaf 320 towards the door frame 321 until in FIG. 21B the toggle-like rotating-lock 318, which is still in the open position, has penetrated the opening 96 of the lock receiving part 92, whereupon first the rotating-lock 318 is rotated 90 degrees with a key not shown here and in a manner detailed for the two other embodiment forms, moving from the position shown in FIG. 21B to the position shown in FIG. 21C. During this process, the door leaf 320 is aligned relative to the door frame 321 in a direction parallel to the folded portion. A further rotation by a further 90 degrees pulls the rotating-lock 318 into its rotating-lock housing 312, by means of which the door leaf 320 is pulled towards the door frame 321, which according to the representation decreases the distance between the two parts by about half.

This distance reduction can be used to press sealing material not shown here together and by means of this effect a sealing of the door.

The advantage of the arrangement according to FIGS. 21A, 21B, 21C and 21D is the fact that the space between the folded portions and the door frame, which is dead, anyhow, can be utilized. Since the sealing for 102 is customarily done between door leaf 320 and door frame 321, it also becomes evident that the closure should advantageously be arranged outside the sealed area of a cabinet, so that no special measures must be taken for its own sealing. This is also valid for the self-tapping screw 94 shown here, since a self-tapped thread is relatively tight, but alternatively, corresponding bolts with nuts and sealing washers which make sealing possible can be used for mounting instead of a self-tapping screw 94.

The embodiment form shown in the Figures is particularly advantageous because it is easy to mount: the rotating-lock component part 312 only needs to be clipped into the corresponding opening from the outside while the component part linked with the door frame 321 can also be attached from the outside with, for example, two self-tapping screws.

The invention can, for example, be applied industrially in the building of switch cabinets and in air-conditioning technology.

While the foregoing description and drawings represent the present invention, it will be obvious to those skilled in the art that various changes may be made therein without departing from the true spirit and scope of the present invention.

What is claimed is:

1. A rotating-lock closure with a traction unit, comprising:

a closure housing that has a socket key opening on one outside end and a rotating lock on tie other, inside end; which can he inserted by one end through a passageway in a wall or a door leaf, matched to the outside cross-section of the housing and which can be fixed in position;

a first bearing area which is open towards the outside end and coaxial with the housing axis and which is intended for a socket key receiving head as well as a second bearing area open toward the opposite inside end of the housing that is adjacent to the first bearing area and which is intended for a rotating-lock driving support that supports said rotating-lock and is mounted so as to be capable of axial and sliding displacement and of rotation in the second bearing area;

a coupling device being provided between the socket key receiving head and the rotating-lock, which device is provided with a cam pin/cam track device for the rotation and/or axial displacement of the rotating-lock relative to the housing upon rotation of the socket key receiving head, and which permits a limited angular freewheeling between the socket key receiving head and the rotating-lock;

a shaft having a rounded cross section and extending from the socket key receiving head protruding beyond the rotating-lock driving support and also having a transverse opening at its protruding end for receiving a cam pin;

a cam track, on which the cam pin is guided against the force of a spring, being formed by the side of the lock facing away from the housing; and the outer periphery of the lock driving support having a non-rounded cross section and being capable, in It passageway also having a non-rounded cross section, of axial and sliding displacement in a first portion of the second bearing area and of limited rotation in a second portion of the second bearing area;

wherein the rotating-lock closure comprises a lock receiving part which can be fixed to the housing or frame and which forms the surface behind which the rotating-lock engages;

wherein the rotating-lock is toggle-shaped;

wherein the lock receiving part has the shape of a cup, the open end of which can be screwed to the seating, the bottom of the cup forming an essentially rectangular opening which permits with some lateral play the passage of a toggle-like rotating-lock when this is in a position aligned with the longitudinal extent of the opening.

2. The rotating-lock closure according to claim 1, wherein the rotation capability is to be restricted to about 90 degrees.

3. The rotating-lock closure according to claim 1, wherein the non-rounded cross section of the lock driving support is a parallelogram.

4. The rotating-lock closure according to claim 1, wherein the non-rounded cross section of the passageway in the second portion consists of two opposing segments of a circle connected with each other by two parallel or approximately parallel side walls or by lug areas projecting into the lumen of the passageway.

5. The rotating-lock closure according to claim 1, wherein the housing is divided into the first and second bearing area by a dividing wall, said dividing wall having a circular passageway for the passage of the shaft which, starting at the socket key receiving head, penetrates the lock driving support.

6. The rotating-lock closure according to claim 5, wherein the socket key receiving head supports itself by a rear ring shoulder on the dividing wall in the first bearing area.

7. The rotating-lock closure according to claim 5, wherein in the second bearing area, a spiral pressure spring supports itself on the dividing wall on one side and on the face of the of the lock driving support on the other side.

8. The rotating-lock closure according to claim 1, wherein the rotating-lock forms a wall which goes around the cam track in a circle and which stops the cam pin from sliding out when it is in its operating position.

9. The rotating-lock closure according to claim 1, including a closure housing which has a flange on the one, outside end and which can be passed through a passageway in a thin wall or a door leaf, by the other, inside end until the flange rests on the wall and can be fixed in this position by means of a union nut, and a retaining clip means wherein the rotating lock forms a construction which is directed towards the housing and which permits the pushing on of a union nut or the insertion of the rotating lock including the assembled housing through an opening in a thin wall.

10. The rotating-lock closure according to claim 1, further comprising a closure housing with a flange or attaching lugs at the one end which can be passed by the other end through a passageway in a thick wall or a door leaf or a flap, until the flange or the attaching lugs rest on the wall and can be fixed in this position by means of holding washers and/or screws.

11. The rotating-lock closure according to claim 1, wherein the rotating-lock has a thread on its free end for receiving an adjusting screw the head of which forms an adjustable rotating-lock support surface.

12. The rotating-lock closure according to claim 1, wherein the lock receiving part forms two rear engaging surfaces that are situated diametrically opposite to each other.

13. The rotating-lock closure according to claim 1, wherein the rotating-lock has a toggle support area with a radial extent which essentially corresponds to the narrower width of the passageway and which aligns the toggle in the closed position relative to the lock receiving part across the longitudinal extent of the opening.

* * * * *